US006519970B1

(12) United States Patent
Rafalovich et al.

(10) Patent No.: US 6,519,970 B1
(45) Date of Patent: Feb. 18, 2003

(54) HIGH-SIDE REFRIGERATION UNIT ASSEMBLY

(75) Inventors: Alexander Rafalovich, Louisville, KY (US); Yurly Zelechenok, Louisville, KY (US); Ramesh Noon, Dearborn Heights, MI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,052

(22) Filed: Nov. 13, 2001

(51) Int. Cl.[7] ..... F25D 19/02; F25D 17/06
(52) U.S. Cl. ..... 62/448; 62/428
(58) Field of Search ..... 62/302, 448, 452, 62/454, 455, 428

(56) References Cited

U.S. PATENT DOCUMENTS 2,175,914 A * 10/1939 Philipp ..... 62/115
2,250,648 A * 7/1941 Philipp ..... 62/116
2,296,725 A * 9/1942 McEwan ..... 62/140
3,712,078 A * 1/1973 Maynard et al. ..... 62/448
4,156,352 A 5/1979 Gelbard et al.
4,416,122 A * 11/1983 Johnson ..... 62/448
4,497,183 A 2/1985 Gelbard et al.
4,704,874 A 11/1987 Thompson et al.
5,154,066 A 10/1992 Choi
5,592,829 A 1/1997 Kim
5,941,092 A 8/1999 Tosaki et al.
6,082,131 A 7/2000 Hirosawa et al.
6,098,705 A 8/2000 Kim
6,170,289 B1 1/2001 Brown et al.

* cited by examiner

*Primary Examiner*—Denise L. Esquivel
*Assistant Examiner*—Melvin Jones
(74) *Attorney, Agent, or Firm*—Armstrong Teasdale LLP

(57) ABSTRACT

A refrigeration unit assembly includes: a compressor, and a condenser oriented in a wrap-around relationship with said compressor.

17 Claims, 3 Drawing Sheets

HIGH-SIDE REFRIGERATION UNIT ASSEMBLY

BACKGROUND OF INVENTION

This invention relates generally to refrigerators, and more particularly, to highside refrigeration component assemblies.

Refrigerators typically include a refrigeration unit including a condenser, a compressor, and an attached evaporator. The compressor and condenser, sometimes referred to as high-side components, are typically located in a machinery compartment formed into a refrigerator cabinet at the bottom and back of the cabinet, sometimes referred to as a doghouse. Especially in larger capacity models, e.g., 16 $ft^3$ or greater, a fan induces a forced draft through the machinery compartment to remove heat from exterior surfaces of the compressor and condenser. See, for example, U.S. Pat No. 4,490,991.

Conventionally, the high-side components are positioned in series within the machinery compartment and occupy space that would more preferably be used as refrigeration compartment storage space. While efforts have been made to reduce the size of machinery compartments with compact combinations of condensers and compressors, restricted access to the machinery compartments and to the high-side components renders periodic service and maintenance of the refrigeration system a daunting task.

SUMMARY OF INVENTION

In one aspect, a refrigeration unit assembly comprising a slide-out base, a compressor mounted to said base, and a condenser mounted to said base and oriented in a wrap-around relationship with said compressor, and a first side wall depending from said base is provided. The first side wall and the condenser define an enclosure about the compressor.

In another aspect, a high-side refrigeration component assembly is provided. The assembly comprises a slide-out base, a compressor coupled to said base, and a condenser coupled to said base and extending about said compressor so as to encompass said compressor between opposite ends of said condenser. A first side wall depends from said base adjacent one end of said compressor, and said first side wall and said compressor define an enclosure about said compressor.

In an additional aspect, a high-side refrigeration unit assembly is provided. The assembly comprises a base, a compressor mounted to said base, a condenser mounted to said base and extending around a first side of said compressor, a fan mounted on a second side of said compressor, and at least one side wall depending from said base and extending from one end of said condenser toward said fan, said condenser and said side wall enclosing said compressor.

In a further aspect, a high-side refrigeration unit for a refrigerator is provided. The unit comprises a base comprising a floor, a first side wall, and a second side wall. A condenser is mounted to said floor and comprises a first end and a second end, said first end adjacent said first side wall, said second end adjacent said second side wall. A fan is coupled to said base and located between said first and said second side walls in a spaced relationship to said condenser, said first and second side walls, said condenser and said fan, thereby forming an enclosure. A compressor mounted in said enclosure.

In still another aspect, a high-side refrigeration component assembly for a machinery compartment of a refrigerator is provided. The assembly comprises a slide-out base, at least one side wall extending from said base, and a fan element coupled to said base adjacent a first portion of said side wall. A condenser is coupled to said base adjacent a second portion of said side wall, and said side wall, said condenser and said fan element together form a three sided enclosure therebetween. A compressor is coupled to said base and situated within said enclosure.

DETAILED DESCRIPTION

Figure 1:
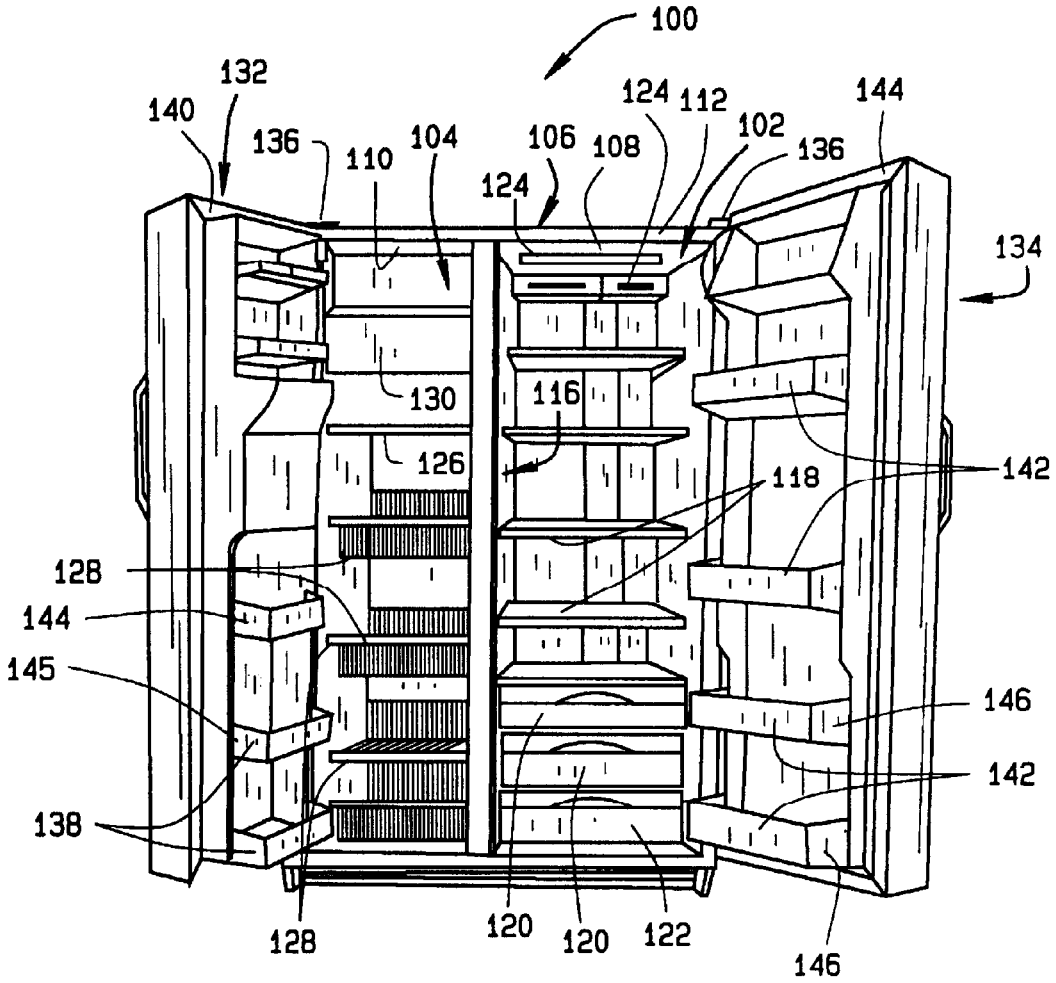
FIG. 1 is a perspective view of an exemplary refrigerator.

FIG. 1 illustrates an exemplary refrigeration appliance 100 in which the present invention may be practiced. In the embodiment described and illustrated herein, appliance 100 is a side-by-side refrigerator. It is recognized, however, that the benefits of the present invention are equally applicable to other types of refrigerators, freezers, and refrigeration appliances. Consequently, the description set forth herein is for illustrative purposes only and is not intended to limit the invention in any aspect.

Refrigerator 100 includes a fresh food storage compartment 102 and a freezer storage compartment 104. Freezer compartment 104 and fresh food compartment 102 are arranged side-by-side within an outer case 106 and defined by inner liners 108 and 110 therein. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case 106. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners 108, 110. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out storage drawers 120, sometimes referred to as storage pans, normally are provided in fresh food compartment 102 to support items being stored therein.

Refrigerator 100 is controlled by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

In accordance with known refrigerators, refrigerator 100 includes a machinery compartment (not shown in FIG. 1) that at least partially contains components for executing a known vapor compression cycle for cooling air. The components include a compressor (not shown in FIG. 1), a condenser (not shown in FIG. 1), an expansion device (not shown), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are sometimes referred to as a sealed system operable to force cold air through refrigeration compartments 102, 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
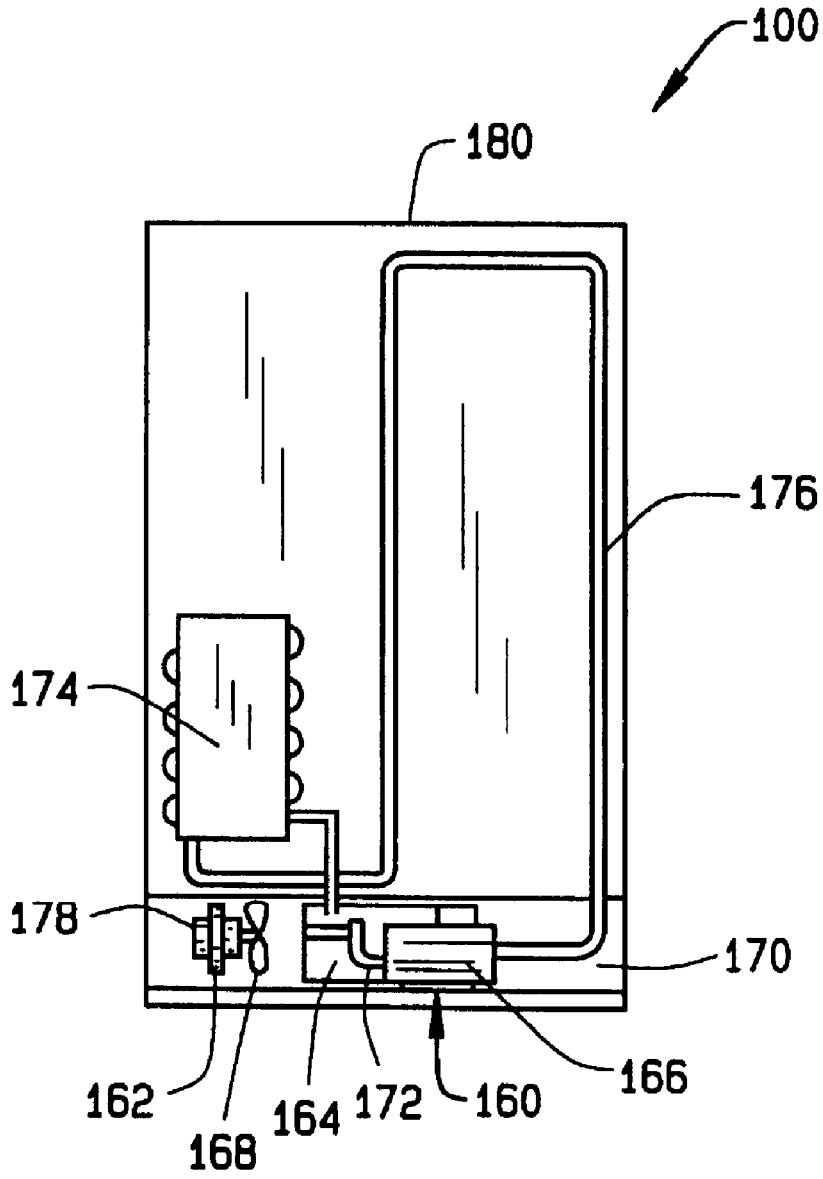
FIG. 2 is a rear elevational schematic view of the refrigerator shown in FIG. 1 including an exemplary high-side refrigeration assembly.

FIG. 2 is a rear elevational schematic view of refrigerator 100 (shown in FIG. 1) including an exemplary high-side refrigeration component assembly or unit 160. High-side unit 160 includes a base 162, a compressor 164, a condenser 166 and a fan element 168 that, unlike conventional systems, and as explained in detail below, facilitates efficient heat transfer in a reduced space within a machinery compartment 170 without unduly restricting access to the components for maintenance and service.

High-side refrigeration unit 160 includes motorized compressor 164 that accepts refrigerant from a condenser system discharge tube (not shown in FIG. 2) and discharges compressed refrigerant into a condenser system inlet tube 172. Compressor 164 draws refrigerant from an evaporator 174 and discharges compressed refrigerant to condenser 166. From the condenser inlet tube inlet tube 172, refrigerant flows thorough a condenser coil (not shown) to a hot gas loop 176 and to a condenser system discharge tube (not shown). A filter dryer (not shown) is connected to the condenser system discharge tube, and a discharge line carries refrigerant passed through the filter dryer to a suction line connected to evaporator 174 according to known methods in the art. Fan element 168 is driven by a fan motor 178 to force air across outer surfaces of motor compressor unit 164 and condenser 166 to enhance heat transfer from compressor 164 and condenser 166, respectively, to ambient air.

High pressure refrigerant condensed in condenser 166 flows to evaporator 174 through a capillary tube (not shown) which restricts the flow of liquid refrigerant to evaporator 174 and maintains a pressure differential between condenser 166 and evaporator 174. An expansion device (not shown) connects the small passage of the capillary tube to the larger passage of evaporator 174.

Compressor 164 adds work to the refrigerant, which heats the refrigerant before flowing into condenser 166. High pressure and high temperature gaseous refrigerant leaves compressor 164 through a discharge port and flows to condenser 166, where high pressure gaseous refrigerant is cooled to a saturation temperature, eventually condensing the refrigerant into a liquid state. Evaporator 174 is a type of heat exchanger which transfers heat from air passing over evaporator 174 to a refrigerant flowing through the evaporator, thereby causing the refrigerant to vaporize. The cooled air is used to refrigerate one or more refrigerator or freezer compartments, such as compartments 102, 104 (shown in FIG. 1) via fans (not shown). It is believed that the above-described vapor compression cycle and the associated components are well known in the art so as to fully appreciated and implemented by those in the art without further explanation.

Condenser 166 includes one or more tubes or pipes of a selected length sufficient to transfer heat to surrounding air in combination with hot gas loop 176. To conserve space, the tubing is arranged in a compact arrangement, such as known spiral configurations and coil configurations in different embodiments, and is fabricated according to known methods. In an exemplary embodiment, and as further described below, condenser 166 is oriented in a wrap-around relationship to compressor 164 such that when fan element 168 is activated, the fan blades draw air through condenser 166 and around compressor 164 nearly simultaneously without the use of conventional baffles and directional air flow features to produce air flow across the desired components. Also, the arrangement of compressor 164 and condenser 166 occupies a reduced space in machinery compartment 170.

In an illustrative embodiment, hot gas loop 176 is integral to a refrigerator cabinet 180 and extends in a rectangular configuration substantially coincident with a front face of refrigerator cabinet 180 in use. It is contemplated that hot gas loop 176, in alternative embodiments, could be located elsewhere either integral to or external to refrigerator cabinet 180 without departing from the scope of the present invention. For example, gas loop 176 may extend coincident with a rear cabinet wall, a side cabinet wall, beneath of floor of refrigerator 100, or other desirable locations apparent to those in the art.

Additionally, it is anticipated that condenser 166 may be employed with an auxiliary condenser system in lieu of hot gas loop 176 without departing from the spirit of the present invention. For example, a condenser coil assembly extending beneath a floor of refrigerator 100 may be employed with condenser 166 to further increase heat transfer of the refrigeration system.

The high-side refrigeration components, or more specifically, compressor 164 and condenser 166 are mounted to a slide out-base 162 to facilitate service and maintenance of unit 160, and flexible connections are made to hot gas loop 176 and evaporator 174 so that base 162 maybe pulled out from refrigerator cabinet 180 for free access to high-side components without dismantling connections to the remainder of the refrigeration system.

Figure 3:
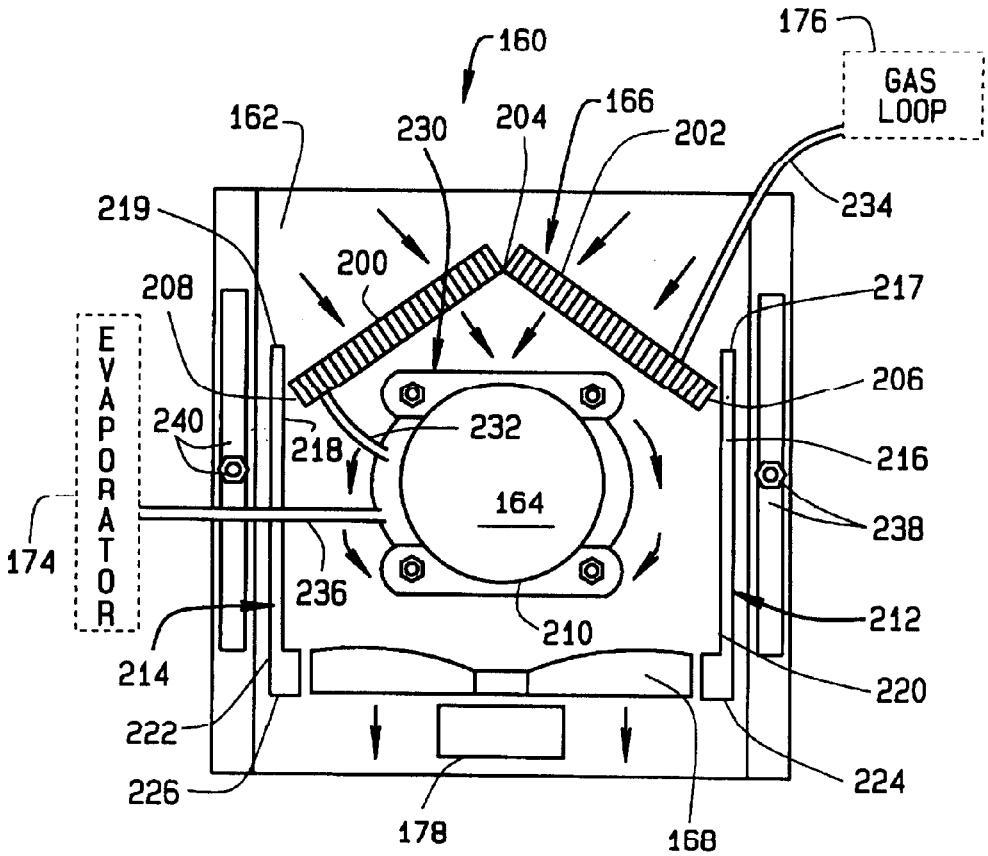
FIG. 3 is a top plan view the high-side refrigeration assembly shown in FIG. 2.

FIG. 3 is a top plan view of high-side refrigeration assembly 160 including base 162, and compressor 164 and condenser 166 mounted to base 162. Condenser 166 is constructed according to known coil condenser techniques and includes two distinct portions 200, 202 operatively coupled together and oriented at an angle to one another so as to form an apex 204 between portions 200, 202 that is substantially aligned with a center of compressor 164. Compressor 166 includes opposite ends 206, 208 extending from respective condenser portions 200, 202 opposite apex 204, and each condenser end 206, 208 is located relative to compressor 164 so as to form an enclosure at one end of compressor 164 that contains, confines, or encompasses compressor 164 between compressor ends 206, 208. In other words, condenser 166 is oriented in a wrap-around relationship to compressor 164 to reduce an occupied machinery compartment space and improve air flow around the high-side refrigeration components for increased heat transfer efficiency while providing adequate access to condenser 166 and compressor 164 for service and maintenance.

While in an illustrative embodiment condenser 166 includes first and second portions 200, 202, it is appreciated that a curved or arcuately extending condenser may be employed to achieve the same effects as the above described condenser 166. Likewise, a condenser having greater than two portions arranged to enclose or encompass one side of compressor 164 may be employed in a further embodiment.

Fan element 168 and fan motor 178 are also coupled to base 164 and are situated on an opposite side of compressor 164 as condenser 166. Thus, when fan motor 178 is energized, air flow is generated by fan element 168 that is substantially perpendicular to condenser portions 200, 202 and around an outer surface 210 of compressor 164, as indicated by the arrows in FIG. 3. In an exemplary embodiment, air flow is further assisted by first and second side walls 212, 214 extending upwardly from base 162. Condenser ends 206, 208 are each located adjacent respective first portions 216, 218 extending from respective first ends 217, 219 of each side wall 212, 214. Fan element 168 extends substantially an entire length between respective second portions 220, 222 extending from second ends 224, 226 of each side wall 212, 214. Thus, condenser, 166, side walls 212, 214 and fan element 168 form an enclosure 230 about all sides of compressor 164, such that when fan element 168 is activated by motor 178, air is drawn into enclosure 230 through condenser 166 and around compressor 164.

In an exemplary embodiment, side walls 212, 214 extend substantially parallel to one another, although it is appreciated that in alternative embodiments side walls 212, 214 need not be parallel to achieve at least some of the advantages of the instant invention. Moreover, it is recognized that fan element 168 need not extend a full distance between base side walls 212, 214 to obtain the benefits of the instant invention. Still further, it is recognized that one of side walls 212, 214 may be omitted from base 162 and effectively replaced by a machinery compartment wall. In other words, condenser 166, fan element 168 and one of side walls 212, 214 may form a three sided enclosure 230 about compressor 164 with a machinery compartment wall completing the enclosure. For purposes of description, the illustrative condenser 166 is considered to be one side of the enclosure, even though in the illustrated embodiment it includes two portions 200, 202.

In still a further embodiment, side walls 212, 214 may be replaced by additional condenser portions (not shown) extending from condenser portions 200, 202 that enclose the lateral sides of compressor where side walls 212, 214 extend in the illustrated embodiment. For example, in one such alternative embodiment, additional condenser portions (not shown) could be arranged in a horseshoe configuration about compressor 164 together with condenser portions 200, 202, with compressor 164 centered within the horseshoe such that fan element 168 completes an enclosure about compressor 164 at the ends of the horseshoe.

A condenser inlet tube 232 extends from compressor 164 to condenser 166 and a flexible connector 234 extends between condenser 166 and hot gap loop 176. Hot gas loop 176 is coupled to low-side components, such as evaporator 174, and another flexible connector 236 connects evaporator 174 to compressor 164 thereby completing the closed series flow relationship between refrigeration components. Flexible connectors 234, 236 facilitate slide-out removal of base 162 from refrigerator cabinet 180 (shown in FIG. 2) while high-side refrigeration unit 160 is connected to the refrigeration system. Base 162 is coupled to a refrigerator frame (not shown) with known fasteners 238, 240 in use.

Figure 4:
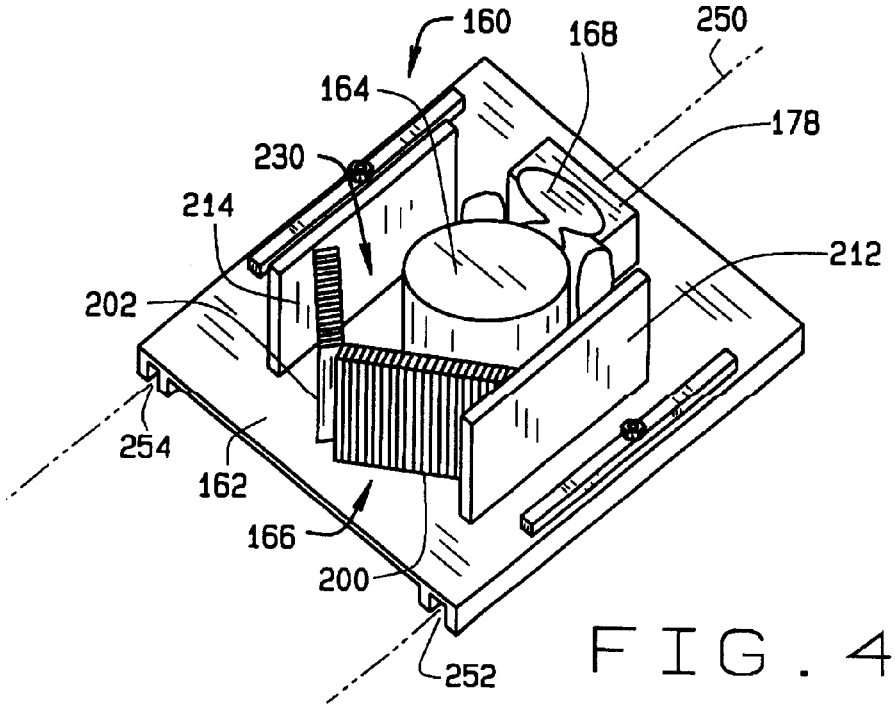
FIG. 4 is a perspective view of the high-side refrigeration assembly shown in FIG. 3.

FIG. 4 is a perspective view of high-side refrigeration unit assembly 160 including condenser 166 enclosing compressor 164 at one end thereof, fan element 168 mounted at an opposite end of compressor 162, and base side walls 212, 214 extending between condenser 166 and fan element 168. Compressor 164 is situated within enclosure 230, and when fan motor 178 is energized, air flows through condenser 166, into enclosure 230, around compressor 164, and is discharged to the ambient environment. Wrap-around condenser 166 facilitates efficient heat transfer from both the condenser surfaces and outer surfaces of compressor 164 in use.

In an illustrative embodiment, high-side assembly is substantially symmetrical about a center longitudinal axis 250. In other words, fan motor 178, fan element 168, compressor 164 and condenser 166 are each substantially aligned along axis 250, and base side walls 212, 214 are each extended substantially parallel to and equidistant from longitudinal axis 250. It is contemplated, however, that asymmetrical arrangements of high-side components may be employed in alternative embodiments without departing from the scope of the instant invention.

Base 162 includes rails 252, 254 for sliding engagement with a refrigerator frame. As such high-side component assembly 160 is modular and may be readily installed and removed from a refrigerator, such as refrigerator 100 (shown in FIG. 1). While in the illustrated embodiment, rails 252, 254 extend substantially parallel to longitudinal axis 250, it is contemplated that in alternative embodiments rails 252, 254 may extend perpendicular to longitudinal axis 250, or even at an oblique angle with respect to axis 250, without departing from the scope of the present invention.

Once removed from refrigerator machinery compartment 170 (shown in FIG. 2) components may be readily accessed for service, maintenance, and repair. In a further embodiment, base side walls 212, 214 are removable to provide further access to condenser 166, compressor 162 and fan element 168.

An efficient high-side refrigeration component assembly is therefore provided that increases serviceability of the refrigeration system while decreasing an occupied space of the components.

While the invention has been described in terms of various specific embodiments, those skilled in the art will recognize that the invention can be practiced with modification within the spirit and scope of the claims.

What is claimed is:

1. A refrigeration unit assembly comprising a slide-out base;

a compressor mounted to said base;

a condenser mounted to said base and oriented in a wrap-around relationship with said compressor; and a first side wall depending from said base, said first side wall and said condenser defining an enclosure about said compressor.

2. A refrigeration unit assembly in accordance with claim 1, said condenser forming an enclosure about said compressor, said assembly further comprising a fan element for circulating air through said enclosure.

3. A refrigeration unit assembly in accordance with claim 1 further comprising a second side wall further defining said enclosure.

4. A high-side refrigeration component assembly comprising:

a slide-out base;

a compressor coupled to said base; and a condenser coupled to said base and extending about said compressor so as to encompass said compressor between opposite ends of said condenser; and a first side wall depending from said base adjacent one end of said compressor, said first side wall and said compressor defining an enclosure about said compressor.

5. A refrigeration unit assembly in accordance with claim 4 further comprising a fan element for circulating air through said enclosure.

6. A refrigeration unit assembly in accordance with claim 5 further comprising a second side wall further defining said enclosure.

7. A high-side refrigeration unit assembly comprising:

a base;

a compressor mounted to said base;

a condenser mounted to said base and extending around a first side of said compressor;

a fan mounted on a second side of said compressor; and at least one side wall depending from said base and extending from one end of said condenser toward said fan, said condenser and said side wall enclosing said compressor.

8. A high-side refrigeration unit assembly in accordance with claim 7 further comprising a second side wall extending from a second end of said condenser toward said fan.

9. A high-side refrigeration unit assembly in accordance with claim 8 wherein said base comprises at least one rail.

10. A high-side refrigeration unit for a refrigerator, said unit comprising;

a base comprising a floor, a first side wall, and a second side wall;

a condenser mounted to said floor and comprising a first end and a second end, said first end adjacent said first side wall, said second end adjacent said second side wall;

a fan coupled to said base and located between said first and said second side walls in a spaced relationship to said condenser, said first and second side walls, said condenser and said fan thereby forming an enclosure; and a compressor mounted in said enclosure.

11. A refrigeration unit in accordance with claim 10, said base comprising at least one rail.

12. A refrigeration unit in accordance with claim 10 wherein said first side wall is substantially parallel to said second side wall.

13. A refrigeration unit in accordance with claim 10 wherein said condenser comprises a first portion and a second portion, said first and second portions forming an apex about said compressor.

14. A refrigeration unit in accordance with claim 10, said compressor substantially centered within said enclosure.

15. A high-side refrigeration component assembly for a machinery compartment of a refrigerator, said assembly comprising:

a slide-out base;

at least one side wall extending from said base;

a fan element coupled to said base adjacent a first portion of said side wall;

a condenser coupled to said base adjacent a second portion of said side wall, said side wall, said condenser and said fan element together forming a three sided enclosure therebetween; and a compressor coupled to said base and situated within said enclosure.

16. A component assembly in accordance with claim 15 wherein said condenser extends in a wrap-around relationship to said compressor.

17. A component assembly in accordance with claim 16 further comprising a second side wall extending between opposite ends of said three sided enclosure.

* * * * *